US005765086A

United States Patent [19]

Kishino et al.

[11] Patent Number: 5,765,086

[45] Date of Patent: Jun. 9, 1998

[54] HEAT FIXING BELT WITH CONDUCTIVE ALUMINUM LAYER TONER RELEASE LAYER AND ELASTIC LAYER DISPOSED THEREBETWEEN

[75] Inventors: Kazuo Kishino, Kawasaki; Hiroaki Kumagai, Yonago; Masaaki Takahashi, Asaka; Hideo Kawamoto, Kawasaki; Hideyuki Hatakeyama, Yokohama, all of Japan

[73] Assignee: Canon Kabushiki Kaisha, Tokyo, Japan

[21] Appl. No.: 727,234

[22] Filed: Oct. 8, 1996

[30] Foreign Application Priority Data

Oct. 9, 1995 [JP] Japan ..... 7-261640

[51] Int. Cl.[6] ..... G03G 15/20

[52] U.S. Cl. ..... 399/329

[58] Field of Search ..... 399/320, 329, 399/333, 335; 219/216, 469.471

[56] References Cited

U.S. PATENT DOCUMENTS 5,471,288 11/1995 Ohtsuka et al. ..... 399/338
5,568,240 10/1996 Ohtsuka ..... 399/335
5,697,037 12/1997 Yano et al. ..... 399/333

FOREIGN PATENT DOCUMENTS 05-9027 12/1985 Japan .
07-11427 1/1995 Japan .

*Primary Examiner*—S. Lee
*Attorney, Agent, or Firm*—Fitzpatrick, Cella, Harper & Scinto

[57] ABSTRACT

A heat fixing belt having an electrically conductive layer in which an eddy current is produced by an alternating magnetic field applied from outside the belt thereby generating heat. The belt further includes toner release layer disposed on the surface of the fixing belt, the fixing belt being characterized in that the electrically conductive layer is an aluminum layer with a thickness less than 35 μm, and having a rubber elastic layer between the aluminum layer and the toner release layer. The rubber elastic layer is disposed between the aluminum layer and the toner release layer making it possible to greatly reduce the time required to heat the fixing belt up to a predetermined temperature necessary for the fixing operation after the electric power is turned on. Thus, the invention can provide a heat fixing apparatus capable of quickly starting the fixing operation.

10 Claims, 3 Drawing Sheets

HEAT FIXING BELT WITH CONDUCTIVE ALUMINUM LAYER TONER RELEASE LAYER AND ELASTIC LAYER DISPOSED THEREBETWEEN

BACKGROUND OF THE INVENTION

1. Field of the Invention

The present invention relates to a heat fixing belt and a heat fixing apparatus provided therewith. More particularly, the present invention relates to a heat fixing belt and a heat fixing apparatus suitable for use in an image forming apparatus such as an electrophotographic apparatus or electrostatic recording apparatus.

2. Description of the Related Art

Various fixing apparatuses are known in the art. In the apparatus designed to fix a color image composed of up to four toner layers of cyan, magenta, yellow, and black, fixing process is accomplished using a fixing roller having a rubber elastic layer disposed on the surface of a cylindrical metal core and having a heating halogen lamp disposed inside the cylindrical metal core.

In the technique disclosed in Japanese Patent Publication No. 5-9027, an eddy current is induced by the magnetic flux in the electrically conductive layer of a fixing roller thereby generating heat on the base of the Joule heating mechanism. The utilization of the eddy current makes it possible to generate heat near the toner, and heating can be performed more efficiently with lower power consumption than the heating roller using a halogen lamp. In the technique disclosed in Japanese Unexamined Patent Publication No. 7-11427, aluminum is employed to form an electrically conductive layer in which an eddy current is induced. However, to quickly start the operation of an electrophotographic apparatus, it is required that the temperature of the heating part of the fixing apparatus be able to rise quickly to the fixing temperature after turning on the electric power.

SUMMARY OF THE INVENTION

Accordingly, it is an object of the present invention to provide a heat fixing belt (also referred to simply as a fixing belt) for generating heat by means of the eddy current, capable of quickly rising in temperature up to the fixing temperature after being turned on.

It is another object of the present invention to provide a heat fixing apparatus which is capable of quickly starting operation, which requires less power in operation, and which is capable of forming a high-quality image on a recording material such as a sheet of copying paper which can be easily separated from the fixing belt by means of curvature separation.

According to an aspect of the present invention, there is provided a fixing belt including: an electrically conductive layer in which an eddy current is produced by an alternating magnetic field applied from the outside thereby generating heat; and a toner release layer disposed on the surface of the fixing belt, the fixing belt being characterized in that the electrically conductive layer is an aluminum layer with a thickness less than 35 μm, and there is further provided a rubber elastic layer between the aluminum layer and the toner release layer. According to another aspect of the present invention, there is provided a heat fixing apparatus including: a fixing belt including an electrically conductive layer in which an eddy current is produced by an alternating magnetic field applied from the outside thereby generating heat, and also including a toner release layer disposed on the surface of the fixing belt; a coil for generating the alternating magnetic field by which the eddy current is induced in the electrically conductive layer; and pressing means which forms, in conjunction with the heat fixing belt, a nipping mechanism, wherein a recording material on which a toner image to be fixed has been formed is nipped and carried by the nipping mechanism thereby fixing the toner image, the heat fixing apparatus being characterized in that the electrically conductive layer is an aluminum layer with a thickness less than 35 μm, and there is provided a rubber elastic layer between the aluminum layer and the toner release layer. The fixing belt according to the present invention is characterized in that the rubber elastic layer is provided between the aluminum layer and the toner release layer. Aluminum is a non-magnetic metal, and the heat generated in the aluminum layer by the eddy current increases with the reduction in the thickness of the aluminum layer. Thus, it is desirable that the thickness of the electrically conductive layer of the fixing belt be less than 35 μm. If the thickness of the electrically conductive layer satisfies the above requirement, the resultant fixing belt will have good flexibility required in operation. The rubber elastic layer disposed between the aluminum layer and the toner release layer makes it possible to greatly reduce the time required to heat the fixing belt up to a predetermined temperature necessary for the fixing operation after the electric power is turned on. Thus, the invention can provide a heat fixing apparatus capable of quickly starting the fixing operation. The above-described effect of the rubber elastic layer results from the following facts. The aluminum layer with a small thickness less than 35 μm has a small heat capacity and a high heat conductivity. As a result, the heat produced by the eddy current scatters and thus it takes a long time for the fixing belt to reach the fixing temperature. However, if a rubber elastic layer is disposed between the aluminum layer and the toner release layer, the rubber elastic layer acts as a heat storage layer, and thus the scattering of heat from the aluminum layer is suppressed. This allows the fixing belt to reach the fixing temperature in a shorter time.

DESCRIPTION OF THE PREFERRED EMBODIMENT

Figure 1:
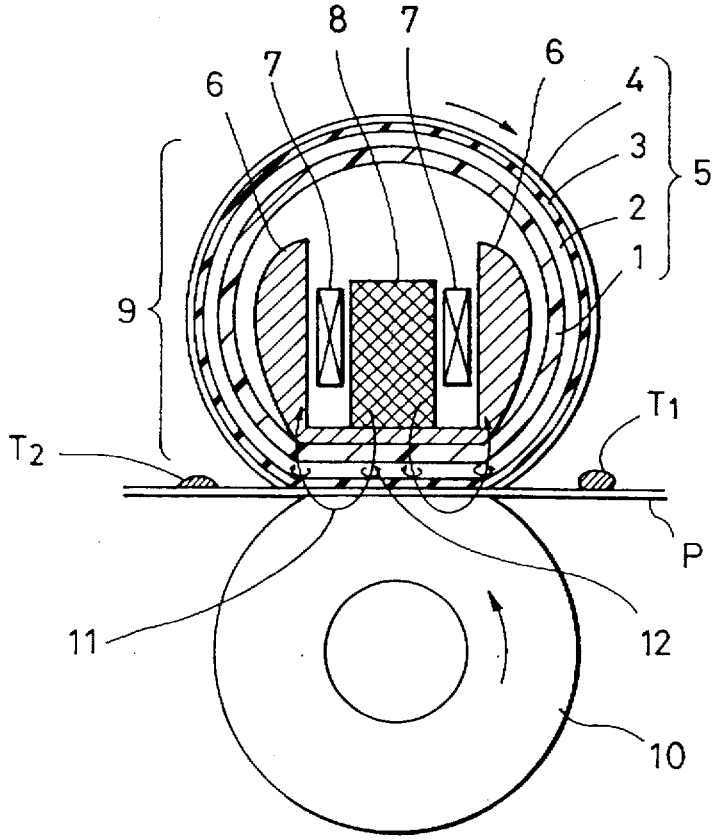
FIG. 1 is a cross-sectional view schematically illustrating a heat fixing apparatus provided with a fixing belt according to the present invention.

The aluminum layer is realized using an aluminum foil or is formed by means of evaporation of aluminum. In a case where the evaporation technique is employed, the aluminum layer can easily be formed by evaporating aluminum on the rubber elastic layer or the heat-resistant resin layer. As for the rubber material of the rubber elastic layer, heat-resistant silicone rubber, fluoro rubber, or the like may preferably be employed. In order for the rubber elastic layer to function well as a heat storage layer, it is preferable that the specific heat of the rubber material be equal to or greater than 0.3 cal/g·° C. and the thickness be equal to or greater than 100

μm. However, in order that the heat generated in the aluminum layer can be transferred efficiently to a recording material, it is preferable that the thickness of the rubber elastic layer be equal to or less than 1 mm. In the case of a color toner image, in particular a color photographic image, the image often includes a large solid area. In such a case, the heating surface should respond well to the unevenness of the surface of a recording material or the toner layer, otherwise nonuniformity occurs in heating which causes nonuniformity of glossiness in the resultant image (areas which have obtained a greater amount of heat become more glossy than areas which have obtained a less amount of heat). To avoid the nonuniformity of the glossiness, it is preferable that the thickness of the rubber elastic layer be equal to or greater than 100 μm. On the other hand, it is desirable that the rubber elastic layer have a hardness equal to or lower than 60° (JIS-A) in order that the fixing belt can respond to the unevenness of the toner image and in order that the recording material can be separated by means of curvature separation, that is, when the recording material reaches a separation point at which the fixing belt is bent to a great degree, the recording material is separated from the fixing belt by means of the rigidity of the recording material itself. In particular, to print a color image, it is more desirable that the hardness of the rubber elastic layer be smaller than 30° (JIS-A). Furthermore, in order to efficiently transfer the heat generated in the aluminum layer to the toner, it is desirable that the rubber elastic layer have a heat conductivity (λ) in the range from $6\times10^{-4}$ to $1.5\times10^{-3}$ cal/cm·sec·° C. If necessary, a filler having good heat conductivity is added in the rubber elastic layer to satisfy the above requirements. The toner release layer serves to prevent the toner fused on a recording material from adhering to the surface of the fixing belt during the fixing process. The toner release layer is made up of a resin having properties suitable for the toner release layer such as PTFE (polytetrafluorethylene), PFA (tetrafluoroethylene/perfluoroalkylvinyl ether copolymer), or FEP (tetrafluoroethylene/hexafluoropropylene copolymer).

Since the toner release layer is as hard as 90° (JIS-A) or greater, if its thickness is too large the ability of the fixing belt to respond to the uneven surface of the toner becomes poor. Accordingly, the thickness of the toner release layer is preferably less than 35 μm and more preferably less than 20 μm.

A preferable technique of forming a thin and smooth toner release layer is to coat an aqueous dispersion of FEP-based resin on the rubber elastic layer and then bake it.

Furthermore, a heat-resistant resin layer may be provided on the other surface of the aluminum layer opposite to the surface on which the rubber elastic layer is formed so as to improve the durability of the heat fixing belt.

Preferably, the heat-resistant resin layer has a thickness in the range from 10 to 100 μm so as to achieve sufficient mechanical strength and good durability without losing good flexibility of the fixing belt.

FIG. 1 is a cross-sectional view schematically illustrating a heat fixing apparatus provided with a fixing belt according to the present invention.

As shown in FIG. 1, the fixing belt 5 includes a heat-resistant resin 1, an aluminum layer 2, a rubber elastic layer 3, and a toner release layer 4. The fixing belt 5 is adapted to rotate in the direction denoted by the arrow. The construction shown in FIG. 1 is only an example, and the fixing belt may be constructed in various ways. For example, a heat-resistant resin layer may be disposed between the aluminum layer and the rubber elastic layer. A primer layer may be disposed between adjacent layers.

Furthermore, there is provided a belt guide 6 which allows the fixing belt 5 to be pressed against the nipping mechanism in a stable manner. The belt guide 6 also functions to support an excitation coil 7 and a high-permeability core magnetic 8.

As for the material of the high-permeability magnetic core 8, a material used as a core of a transformer such as ferrite or permalloy may preferably be employed. More preferably, ferrite exhibiting low loss even at frequencies higher than 100 kHz is employed.

The excitation coil 7 is connected to an excitation circuit (not shown) which can generate high frequency power in the range from 20 kHz to 500 kHz with a switching power supply.

Fixing means 9 is formed with the above-described fixing belt 5, belt guide 6, excitation coil 7, and high-permeability magnetic core 8. A pressure roller 10 is generally constructed with a cylindrical metal core covered with an elastic layer having high heat resistance such as silicone rubber fluoro rubber. A resin having good toner releasing properties such as fluororesin and silicone resin may further be coated on the elastic layer of the pressure roller 10. In a specific embodiment which will be described later, the pressure roller is constructed with a silicone rubber roller including a cylindrical metal core whose periphery is coated with silicone rubber and further covered with a PFA tube.

In a fixing process, the pressure roller is driven in the direction denoted by the arrow, and a recording material such as a sheet of copying paper (P) on which toner ($T_1$) to be fixed is placed is passed through a nipping mechanism formed with the fixing belt 5 and the pressure roller 10 thereby fixing the toner by means of heating.

The heating operation with the nipping mechanism is based on the following principle. That is, as shown in FIG. 1, when an electric current is passed through the excitation coil 7 by the excitation circuit (not shown), a magnetic flux is created by the electric current. The magnetic flux is directed into the high-permeability magnetic core 8. When the magnetic flux 11 reaches the nipping mechanism, an eddy current is induced in the aluminum layer 2 of the fixing belt 5. Since the aluminum layer 2 has specific electrical resistance, the eddy current flowing through the aluminum layer 2 causes generation of heat.

The recording material (P) and the toner ($T_1$) thereon passing through the nipping mechanism are heated via the toner release layer 4 by the heat generated in the aluminum layer 2. Thus, the toner ($T_1$) is fused when it passes through the nipping mechanism. After having passed through the nipping mechanism, the recording material is separated from the fixing belt by means of curvature separation. The recording material is then cooled and thus a permanent image is formed thereon.

Figure 2:
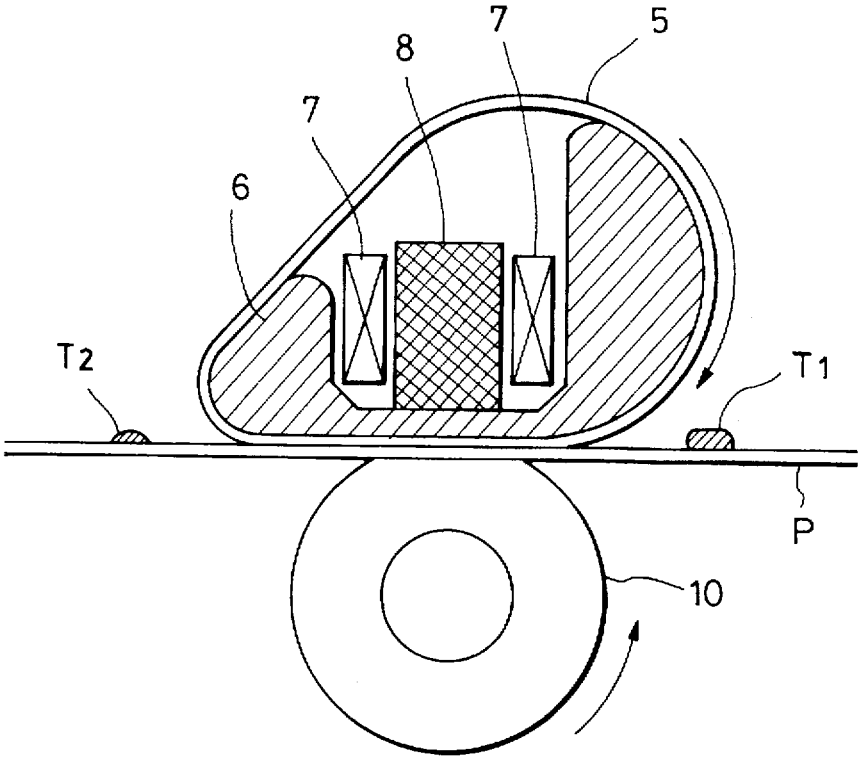
FIG. 2 is a cross-sectional view schematically illustrating a heat fixing apparatus provided with a fixing belt having the capability of curvature separation, according to the present invention.

FIG. 2 is a cross-sectional view schematically illustrating a heat fixing apparatus provided with a fixing belt having the capability of curvature separation. In this heat fixing apparatus, the fixing belt having a rather low rigidity moves along the path shown in FIG. 2 and comes into contact with the pressure roller 10. This allows the recording material (P) to be separated from the fixing belt by means of curvature separation.

Figure 3:
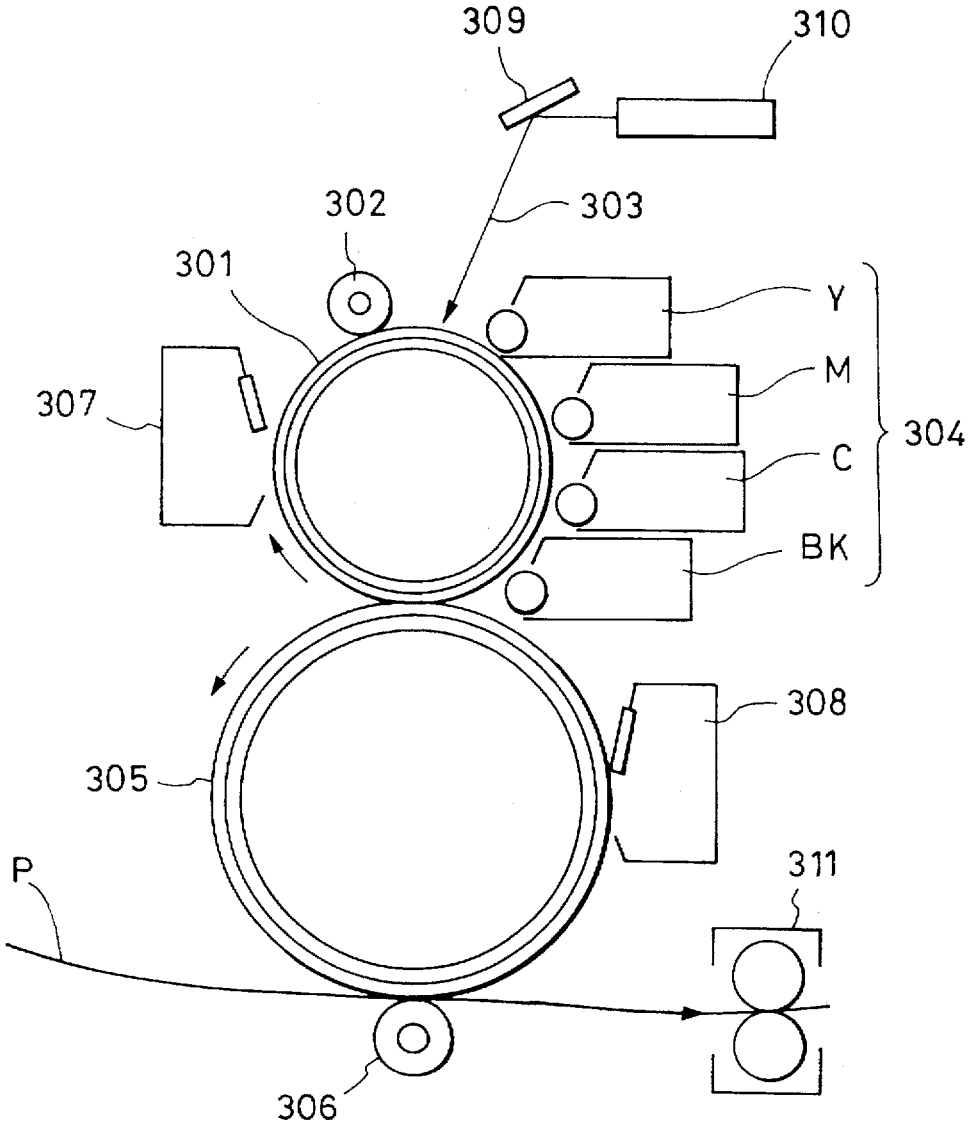
FIG. 3 is a cross-sectional view schematically illustrating an electrophotographic color printer provided with a heat fixing apparatus having a fixing belt according to the present invention.

FIG. 3 is a cross-sectional view schematically illustrating an electrophotographic color printer provided with a heat fixing apparatus having a fixing belt according to the present invention. As shown in FIG. 3, the electrophotographic color printer includes: a photoconductive drum 301 made up of an organic photoconductive material or amorphous silicon; a charging roller 302 for uniformly charging the above photoconductive drum 301; a laser optical system 310 which converts a signal supplied from an image signal generator (not shown) into an on/off-signal of laser beam 303 by which an electrostatic latent image is formed on the photoconductive drum 301; and a mirror 309.

A developing device 304 applies toner selectively to the photoconductive drum 301 thereby visualizing the electrostatic latent image on the photoconductive drum 301. The developing device 304 includes a black developing unit (BK) and three color developing units for yellow (Y), magenta (M), and cyan (C). The latent image on the photoconductive drum 301 is developed successively from one color to another by these developing units. The resultant toner images are successively superimposed on an intermediate transfer drum 305 so as to form a color image.

The intermediate transfer drum 305 includes an elastic layer having a moderate resistance disposed around a metal drum and further includes a surface layer having a high resistance disposed on the elastic layer. A bias voltage is applied to the metal drum so that the resulting difference in voltage between the photoconductive drum 301 and the metal drum can cause the toner image to be transferred from the photoconductive drum 301 to the intermediate transfer drum 305.

The excess toner and dust of paper remaining on the photoconductive drum 301 and the intermediate transfer drum 305 are removed by cleaners 307 and 108. The processing step of charging and the steps following that steps are performed repeatedly.

EXAMPLE

The performance of the fixing belt in terms of the increase in temperature was evaluated.

Belts having various layer structures were placed so that a magnetic field could be applied at a right angle to the aluminum layer from the side opposite to the toner release layer. The increase in temperature of the surface of the toner release layer was evaluated for each belt under the following conditions.

Size of the high-permeability magnetic core: 5 mm (width) ×10 mm (height) ×50 mm (length)

Applied power: 30 W

Frequency: 260 KHz

Size of the fixing belt: 100 mm ×125 mm

The test results are summarized in Table 1.

TABLE 1

| | Layer structure | | | | Temperature rising time (sec) | | |
|---|---|---|---|---|---|---|---|
| Sample | Heat-resistant layer | Aluminum layer | Rubber elastic layer | Toner release layer | 100° C. | 150° C. | 180° C. |
| Comparative Example 1 | 60 μm | 15 μm | none | 10 μm | 5 | 32 | 95 |
| Comparative Example 2 | 60 μm | 15 μm | none | 25 μm | 5 | 30 | 92 |
| Example 1 | 60 μm | 15 μm | 100 μm | 10 μm | 4 | 9 | 59 |
| Example 2 | none | 15 μm | 150 μm | 10 μm | 4 | 10 | 42 |
| Example 3 | 60 μm | 15 μm | 150 μm | 10 μm | 5 | 11 | 55 |
| Example 4 | none | 15 μm | 250 μm | 10 μm | 5 | 11 | 20 |
| Example 5 | 20 μm | 15 μm | 250 μm | 10 μm | 8 | 14 | 28 |
| Example 6 | 60 μm | 15 μm | 250 μm | 10 μm | 13 | 23 | 46 |
| Example 7 | none | 30 μm | 100 μm | 15 μm | 6 | 12 | 54 |

Notes:
Heat-resistant resin layer: polyimide resin
Rubber elastic layer: silicone rubber
(specific heat: 0.32 cal/g/°C.)
(hardness: 30° (JIS A))
(heat conductivity: $1.0 \times 10^{-3}$ cal/cm · sec °C.)
Toner release layer: FEP fluororesin A sheet of copying paper (recording material) P fed from a copying-paper cassette via a paper feeding roller passes timely between an image transfer roller 306 and the intermediate transfer drum 305 so that the electrostatic latent image on photoconductive drum 301 is transferred at a correct position on the copying paper. The image transfer roller 306 supplies an electric charge, which has an opposite polarity to the toner, to the sheet of copying paper P from its back side thereby transferring the toner image from the intermediate transfer drum 305 onto the sheet of copying paper. In the heat fixing apparatus 311, heat and pressure are then applied to the sheet of copying paper (P) having the toner image to be fixed so that the toner is fused to the sheet of copying paper P thereby forming a permanent image. The sheet of copying paper is fed out onto a copied-paper tray (not shown).

As can be seen from Table 1, in the structures in which a toner release layer is disposed directly on an aluminum layer, although the surface temperature quickly rises to 100° C., it takes a long time to rise to a higher temperature. On the other hand, in the structures in which a toner release layer is disposed on an aluminum layer via a rubber elastic layer, the surface temperature can quickly rise up to 150° C.

The fixing belts of Examples 1–7 were separately installed in a heat fixing apparatus of a color printer having the structure shown in FIG. 3, and the performance of forming an image was evaluated.

The fixing belts of Examples 1–6 were installed in a heat fixing apparatus having the structure shown in FIG. 2 while the fixing belt of Example 7 was installed in a heat fixing apparatus having the structure shown in FIG. 1.

In each example, the temperature rose to a temperature suitable for the fixing operation (190° C.) in a short time, and the fixed image had good quality without having nonuniformity.

TABLE 2

| | Structure of the fixing belt | | | | |
|---|---|---|---|---|---|
| | Heat resistant layer | Aluminum layer | Rubber elastic layer | Toner release layer | Heat fixing apparatus |
| Example 1 | 60 μm | 15 μm | 100 μm | 10 μm | Fig. 2 |
| Example 2 | none | 15 μm | 150 μm | 10 μm | Fig. 2 |
| Example 3 | 60 μm | 15 μm | 250 μm | 10 μm | Fig.2 |
| Example 4 | none | 15 μm | 250 μm | 10 μm | Fig. 2 |
| Example 5 | 20 μm | 15 μm | 250 μm | 10 μm | Fig. 2 |
| Example 6 | 60 μm | 15 μm | 250 μm | 10 μm | Fig. 2 |
| Example 7 | none | 30 μm | 100 μm | 15 μm | Fig. 1 |

What is claimed is:

1. A heat fixing belt comprising:

an electrically conductive aluminum layer with a thickness of 35 μm or less for producing heat in accordance with an eddy current induced by an applied alternating magnetic field;

a toner release layer disposed on a surface of the fixing belt; and a rubber elastic layer disposed between said conductive aluminum layer and said toner release layer.

2. A heat fixing belt according to claim 1, wherein said rubber elastic layer has a thickness ranging from 100 μm to 1 mm.

3. A heat fixing belt according to claim 1, wherein a rubber material constituting said rubber elastic layer has a specific heat equal to or greater than 0.3 cal/g° C.

4. A heat fixing belt according to claim 1, wherein said toner release layer has a thickness equal to or less than 35 μm.

5. A heat fixing belt according to claim 4, wherein aid toner release layer has a thickness equal to or less than 20 μm.

6. A heat fixing belt according to claim 1, wherein said toner release layer is formed by coating an aqueous dispersion on said rubber elastic layer.

7. A heat fixing belt according to claim 1, further comprising a heat-resistant resin layer disposed on a surface of said conductive aluminum layer opposite to a surface on which said rubber elastic layer is disposed.

8. A heat fixing apparatus comprising:

a fixing belt having: an electrically conductive aluminum layer with a thickness of 35 μm or less for producing heat in accordance with an eddy current induced by an applied alternating magnetic field;

a toner release layer disposed on a surface of said fixing belt;

a coil for generating the alternating magnetic field and inducing the eddy current in said electrically conductive aluminum layer;

pressing means for forming, in conjunction with said fixing belt, a nipping mechanism, wherein a sheet of copying paper on which a toner image to be fixed has been formed is nipped and conveyed by the nipping mechanism thereby fixing the toner image; and a rubber elastic layer disposed between said electrically conductive aluminum layer and said toner release layer.

9. A heat fixing apparatus according to claim 8, wherein said rubber elastic layer has a thickness ranging from 100 μm to 1 mm.

10. A heat fixing apparatus according to claim 8, wherein a rubber material constituting said rubber elastic layer has a specific heat equal to or greater than 0.3 cal/g° C.

* * * * *

UNITED STATES PATENT AND TRADEMARK OFFICE

CERTIFICATE OF CORRECTION

PATENT NO. : 5,765,086

DATED : June 9, 1998

INVENTOR(S) : KAZUO KISHINO, ET AL.

It is certified that error appears in the above-identified patent and that said Letters Patent is hereby corrected as shown below:

Title page,

At [54] TITLE

Line 2, "ALUMINUM LAYER" should read --ALUMINUM LAYER,--.

Column 1

Line 2, "ALUMINUM LAYER" should read --ALUMINUM LAYER,--.

Column 4

Line 6, "core magnetic 8." should read --magnetic core 8.--

Signed and Sealed this

Second Day of March, 1999

*Attest:*

*Attesting Officer*

Q. TODD DICKINSON

*Acting Commissioner of Patents and Trademarks*